US005315983A

United States Patent [19]

Law

[11] Patent Number: 5,315,983

[45] Date of Patent: May 31, 1994

[54] WOK SUPPORT RING

[76] Inventor: Kam C. Law, 1933 Arriba Dr., Monterey Park, Calif. 91754

[21] Appl. No.: 977,676

[22] Filed: Nov. 18, 1992

[51] Int. Cl.[5] ..... F24C 15/10

[52] U.S. Cl. ..... 126/216; 126/50; 126/214 D; 126/215; 248/146

[58] Field of Search ..... 126/215, 50, 214 C, 126/214 D, 216, 218, 214 R; 248/146

[56] References Cited

U.S. PATENT DOCUMENTS

| | | | |
|---|---|---|---|
| 307,666 | 11/1884 | Manning . | |
| 698,017 | 4/1902 | Hoerlein . | |
| 730,268 | 6/1903 | Keller | 126/214 C |
| 862,719 | 8/1907 | Davis | 126/215 |
| 1,072,115 | 9/1913 | Harmon | 126/214 C |
| 1,316,365 | 9/1919 | Jackson | 248/146 X |
| 1,367,333 | 2/1921 | Truesdell | 126/215 |
| 2,797,298 | 6/1957 | Fujitani | 126/215 X |
| 2,898,905 | 8/1959 | Thomas | 126/215 X |
| 3,391,687 | 7/1968 | Hutner, Jr. et al. | 126/215 |
| 4,332,188 | 6/1982 | Rhear | 99/323 |
| 4,435,638 | 3/1984 | Simon et al. | 219/460 |
| 4,448,186 | 5/1984 | Smith | 126/215 |
| 4,603,684 | 8/1986 | Kazuo et al. | 126/215 X |
| 4,607,613 | 8/1986 | Toldi | 126/215 |
| 4,643,164 | 2/1987 | LaForge | 126/44 |
| 4,873,921 | 10/1989 | Piane, Sr. | 99/422 |
| 4,889,103 | 12/1989 | Fraioli | 126/92 |

*Primary Examiner*—Carl D. Price

*Attorney, Agent, or Firm*—Blakely, Sokoloff, Taylor & Zafman

[57] ABSTRACT

A two-piece support ring structure for supporting a wok cooking vessel on top of a burner cylinder of a cooking range. The structure features two components: a top ring of a substantially circular shape upon which sits a wok; and a base ring having a substantially circular shape that removably rests on the burner cylinder. The top ring removably rests on the base ring. The base ring itself comprises a first ring and a first mating means disposed on top of the first ring for removably coupling the base ring to the top ring. The top ring comprises a second ring upon which sits the wok, and a second mating means projecting from the bottom of the second ring for removably coupling the top ring to the first mating means. The base ring further comprises a third mating means for removably coupling the base ring to the burner cylinder.

16 Claims, 2 Drawing Sheets

WOK SUPPORT RING

BACKGROUND OF THE INVENTION

1. Field of the Invention

The present invention relates generally to food preparation devices and more specifically to a support ring structure for supporting a wok cooking vessel on top of a cooking range.

2. Art Background

Over the past few decades, health conscious Americans have turned to the East in search of cooking techniques using a minimum amount of fats and oils. One such technique involves the use of a Chinese wok, which usually requires cooking of vegetables and meats for very short time periods at high heats. In a typical stir-fry recipe, the cooking time is four minutes or less. The health benefits of short-time cooking with minimal use of fats are substantial. Less fat is absorbed by the food being cooked in a wok than with Western methods and consequently the fat intake of the consumer is minimized. In addition to the health benefits, the flavor of the food items, particularly of the vegetables, is substantially retained by the high temperature sealing of the food surfaces.

The traditional wok is also very useful because it is easily cleaned between courses. The rounded smooth metal surface may be wiped out or dumped for cleaning with very little residue. Thus, it is possible to cook multiple course meals in the same vessel.

One of the main disadvantages to the use of the wok by modern Western cooks is that it does not adapt well to use on electric and gas ranges. The wok was developed to be placed directly on hollowed-out sections of coals on the ground and/or on rings with a wide base fire built underneath. However, the cooking surfaces utilized in the United States are typically flat in order to deliver heat to flat-bottomed cooking vessels such as frying pans or sauce pans. The spherical surface of the wok does not adapt well to cooking on modern electric and gas ranges.

Commercial ranges for use in Chinese restaurants accommodate woks on the range tops by providing burner cylinders, at the bottom of which sit burners for heating the wok. The wok itself rests on top of the cylinder. Part of the wok is raised above the edge of the cylinder to create a gap through which air can reach the burner. In conventional wok ranges, this separation is often provided by steel studs welded to the cylinder. Frequently only two or three studs are welded to the top edge of the cylinder near the back of the range so that when the wok rests in the cylinder, the wok is tilted towards the cook and air enters through the gap created near the back of the range top.

One problem with the use of studs to set off the wok from the burner cylinder is that the studs dent the wok as the wok is shaken during cooking. After prolonged use, the wok may become so severely dented that it may have to be replaced.

One solution to this problem provides for the welding of a circular ring onto the burner cylinder, the ring being set off from the cylinder top by a number of studs. However, although the welded ring minimizes the denting of the wok, one disadvantage of the ring is that it eventually burns down due to high temperatures used in wok cooking. Replacement of these rings requires an expensive field service call to weld a new ring onto the burner cylinder.

SUMMARY OF THE INVENTION

It is therefore an object of the present invention to provide a support structure for a wok that prevents the wok from being dented as it is shaken during the cooking process.

It is a further object of the present invention to provide a wok support structure that does not require welding to the burner cylinder, thus allowing easy replacement of the wok without the need for an expensive field service call.

Accordingly, the present invention provides a two-piece support ring structure for supporting a wok cooking vessel on top of a burner cylinder of the cooking range. The structure features two components: a top ring of a substantially circular shape adapted to receive a wok; and a base ring having a substantially circular shape that removable rests on the burner cylinder. The top ring removably rests on the base ring. The base ring itself comprises a first ring and a first mating means disposed on top of the first ring for removably coupling the base ring to the top ring. The top ring comprises a second ring adapted to receive the wok, and a second mating means projecting from the bottom of the second ring for removably coupling the top ring to the first mating means. The base ring further comprises a third mating means projecting from the bottom of the first ring for removably coupling the base ring to the burner cylinder.

The present invention thus overcomes the disadvantages of the prior art by providing a two ring structure that is fitted into the burner cylinder without the need for welding. When the rings burn down, they may easily be replaced by the user without the need for welding a new ring onto the range. The top ring will typically wear down faster and require more frequent replacement than the base ring because the top ring is constantly being hit by the wok as the wok is agitated during cooking. Thus, the present invention comprises two ring components so that the entire structure need not be replaced when the top ring wears down.

BRIEF DESCRIPTION OF THE DRAWINGS

The objects, features and advantages of the present invention will be apparent to one skilled in the art in light of the following detailed description in which.

DETAILED DESCRIPTION OF THE INVENTION

The present invention will be described in accordance with a number of embodiments. One of ordinary skill in the art will realize that the present invention is not limited to the embodiments described herein. For example, the components of the support ring structure may be fashioned into different shapes and may be joined together in different manners, yet still achieve the objects of the present invention.

Figure 1:
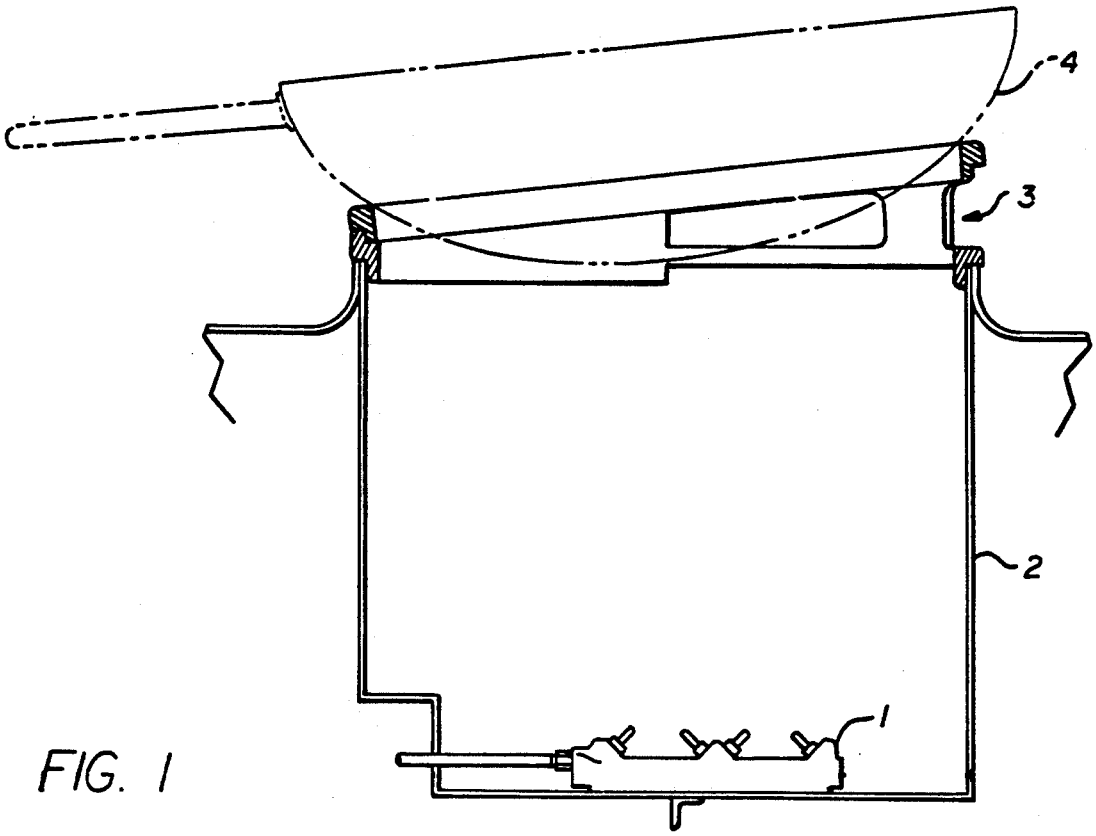
FIG. 1 is a side sectional view of the present invention shown fitted into a burner cylinder of a wok cooking range and supporting a wok.

FIG. 1 illustrates the present invention in the context of its use on a commercial cooking range. Burner 1 sits at the bottom of burner cylinder 2 in the Chinese wok range. The wok support ring structure 3 of the present invention rests in the burner cylinder 2 and supports wok 4.

Figure 2:
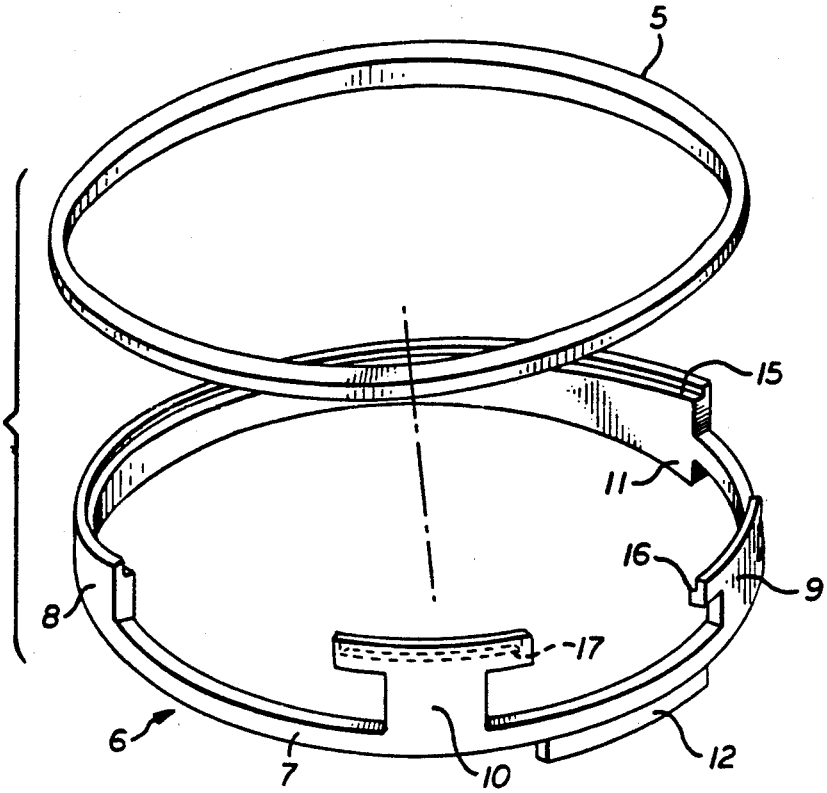
FIG. 2 is an exploded perspective view of the two ring structure of the present invention.

FIG. 2 is an exploded perspective view of the present invention. The wok support ring structure comprises a top ring 5, which sits on a base ring 6. Each ring may be formed of one piece of strong, heat resistant material, typically metal such as iron or steel. Alternatively, each ring may be comprised of separate component parts secured to each other.

Figure 3:
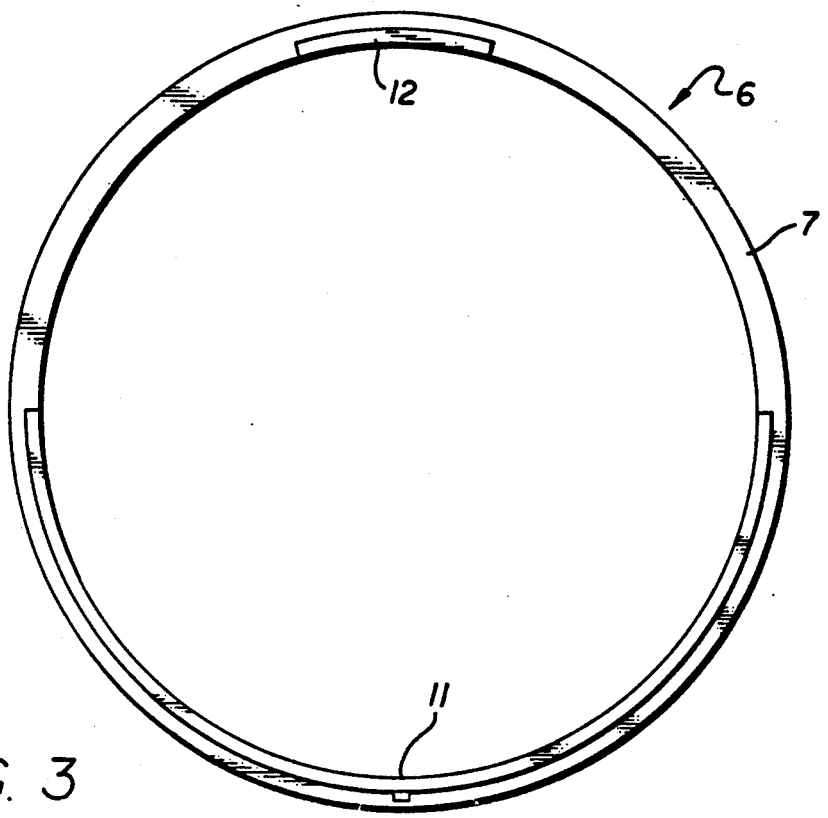
FIG. 3 is a bottom view of the present invention.

The base ring 6 has a substantially circular shape defined by ring 7 from which protrudes arcuate standoff 8 and first and second standoffs 9 and 10. Arcuate standoff 8 and first and second standoffs 9 and 10 mate with and support top ring 5. From the bottom of ring 7 protrudes tabs 11 and 12. Tabs 11 and 12 have outer radii less than the radius of ring 7, but substantially equal to the radius of burner cylinder 2. When the base ring 6 rests on the burner cylinder 2, the tabs 11 and 12 abut the inner sides of burner cylinder 2 to inhibit lateral movement of the base ring 6 with respect to burner cylinder 2. The relationship of the radii of tabs 11 and 12 to the radius of ring 7 is more clearly shown in FIG. 3.

Figure 4:
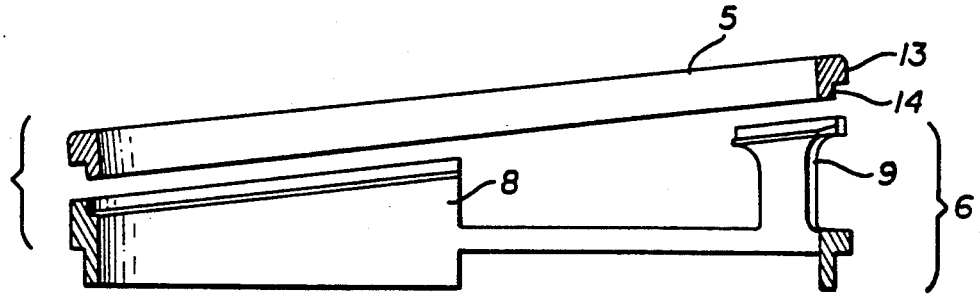
FIG. 4 is a side sectional view of an alternative embodiment of the present invention.

FIG. 4 is a side sectional view of the present invention. Arcuate standoff 8 and first and second standoffs 9 and 10 are angled so that top ring 5 is inclined at a predetermined angle when resting on the standoffs. Thus, when the wok 4 rests on top ring 5, the wok is tilted toward the cook. The angle is chosen to make it easier for the cook to reach the food at the back of the wok with cooking utensils.

The gaps between standoffs 8, 9 and 10 allow oxygen to reach burner 1. In one embodiment, the distance between standoff 9 and one end of arcuate standoff 8 is the same as the distance between standoff 10 and the other end of arcuate standoff 8.

As shown in FIG. 4, the top ring 5 comprises a ring 13 from the bottom of which projects a flange 14. The outer diameter of flange 14 is less than the outer diameter of the ring 13.

Figure 5:
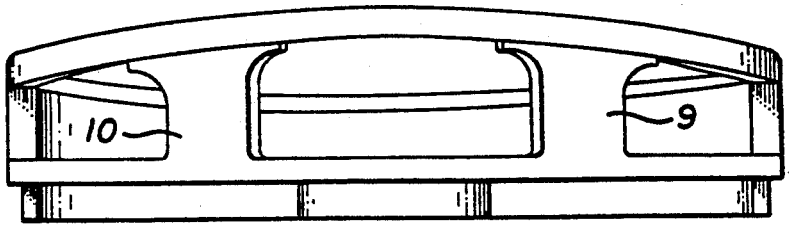
FIG. 5 is a rear view of the present invention.

As shown in FIG. 5, the first and second standoffs 9 and 10 may be fashioned to have a substantially "T" shape, with the top part of the "T" structure angled appropriately so that the top ring 5 is inclined at the predetermined angle when resting on standoffs 8, 9 and 10.

Referring back to FIG. 2, arcuate standoff 8 and first and second standoffs 9 and 10 may be machined to have ledges 15, 16 and 17 for mating with flange 14 of the top ring 5. With this arrangement, the flange 14 abuts the inner sides of the standoffs to inhibit lateral movement of top ring 5 with respect to base ring 6.

By utilizing a two ring structure, the top ring 5 may be easily replaced when it becomes worn down without the need for rewelding the top ring to the range top. Moreover, because the base ring 6 drops into burner cylinder 2, installation and replacement of the entire structure is accomplished without the need for an expensive field service call.

Although the invention has been described in conjunction with preferred embodiments, it will be appreciated that various modifications and alterations might be made by those skilled in the art without departing from the spirit and scope of the invention.

I claim:

1. A support ring structure for supporting a wok cooking vessel on on top of a burner cylinder of a cooking range, the structure comprising:
- a top ring having a substantially circular shape and adapted to receive the wok;
- a base ring having a substantially circular shape, the base ring comprising:
  - a first ring;
  - first mating means for removably coupling the base ring to the top ring; and
  - second mating means for removably coupling the base ring to the burner cylinder.

2. The structure of claim 1, wherein the first mating means is disposed on the first ring.

3. The structure of claim 2, wherein the first mating means projects from the top of the first ring.

4. The structure of claim 1, wherein the second mating means is disposed on the first ring.

5. The structure of claim 4, wherein the second mating means projects from the bottom of the first ring.

6. The structure of claim 1, wherein the second mating means comprises a plurality of tabs circumferentially projecting from the bottom of the first ring, wherein the outer radii of the tabs are less than the radius of the first ring, the tabs abutting the inner sides of the burner cylinder to inhibit lateral movement of the base ring with respect to the burner cylinder when the base ring rests on the burner cylinder.

7. A support ring structure for supporting a wok cooking vessel on top of a burner cylinder of a cooking range, the structure comprising:
- a top ring having a substantially circular shape and adapted to receive the wok; and
- a base ring having a substantially circular shape, the base ring comprising:
  - a first ring;
  - means for removably coupling the base ring to the burner cylinder of the cooking range; and
  - mating means for removably coupling the base ring to the top ring, the first mating means comprising a plurality of standoffs projecting from the top of the first ring, the top ring removably resting on the standoffs, each said standoff having an inner side facing the center of the first ring, the standoffs comprising:
    - an arcuate standoff projecting from the top of the first ring along a first portion of the circumference of the first ring, said first portion having a circumferential center, a first end and a second end;
    - a first standoff projecting from the top of the first ring at a first distance from the first end; and
  - a second standoff projecting from the top of the first ring at said first distance from the second end, wherein
    - at the circumferential center of the first portion the arcuate standoff has a first height, the arcuate standoff rising at a first angle to a second height at the first and second ends of the first portion; and
    - the highest point of the first and second standoffs has a height greater than said second height so that the top ring is inclined at said first angle when resting upon the arcuate standoff and the first and second standoffs.

8. The structure of claim 7, wherein the first standoff comprises:

a first vertical member projecting from the top of the first ring; and a first arcuate member extending from the first vertical member, and angled so that the top ring is inclined at said first angle when the top ring rests on the standoffs;

the second standoff comprises:

a second vertical member projecting from the top of the first ring; and a second arcuate member extending from the second vertical member, and angled so that the top ring is inclined at said first angle when the top ring rests on the standoffs.

9. A support ring structure for supporting a wok cooking vessel on top of a burner cylinder of a cooking range, the structure comprising:

a top ring having a substantially circular shape;

a base ring having a substantially circular shape, the base ring comprising:

a first ring; and first mating means for removably coupling the base ring to the top ring, the top ring comprising:

a second ring adapted to receive the wok; and second mating means for removably coupling the top ring to the first mating means.

10. The structure of claim 9, wherein the top ring comprises:

a second ring adapted to receive the wok; and a flange circumferentially projecting from the bottom of the second ring, wherein the outer diameter of the flange is less than the outer diameter of the second ring; and the flange abuts the inner sides of the standoffs to inhibit lateral movement of the top ring with respect to the base ring when the top ring rests on the base ring.

11. The structure of claim 10, wherein each said standoff comprises a ledge disposed along its inner side, whereby said flange rests on each said ledge of each said standoff.

12. The structure of claim 9, wherein the first mating means is disposed on the first ring.

13. The structure of claim 12, wherein the first mating means projects from the top of the first ring.

14. The structure of claim 9, wherien the second mating means is disposed on the second ring.

15. The structure of claim 14, wherein the second mating means projects from the bottom of the second ring.

16. A support ring structure for supporting a wok cooking vessel on top of a burner cylinder of a cooking range, the structure comprising:

a base ring adapated on the burner cylinder of the cooking range, the base ring comprising:

a first ring having a substantially circular shape;

an arcuate standoff projecting from the top of the first ring along a first portion of the circumference of the first ring, said first portion having a circumferential center, a first end and a second end, wherein at the circumferential center of the first portion the arcuate standoff has a first height, said arcuate standoff rising at a first angle to a second height at the first and second ends of the first portion, and said arcuate standoff having a ledge disposed along the inner side of the arcuate standoff facing the center of the first ring;

a first standoff projecting from the top of the first ring at a first distance from the first end comprising:

a first vertical member projecting from the top of the first ring; and a first arcuate member extending from the first vertical member; and a ledge disposed along the inner side of the first standoff facing the center of the first ring;

a second standoff projecting from the top of the first ring at said first distance from the second end comprising:

a second vertical member projecting from the top of on the first ring;

a second arcuate member extending from the second vertical member; and a ledge disposed along the inner side of the second standoff facing the center of the first ring;

a first arcuate tab circumferentially projecting from the bottom of the first ring, and occupying the first portion of the circumference of the first ring;

a second arcuate tab circumferentially projecting from the bottom of the first ring, the center of the second arcuate tab positioned diametrically across from the circumferential center of the first portion, wherein the outer radii of the first and second arcuate tabs are less than the radius of the first ring, the tabs abutting the inner sides of the burner cylinder to inhibit lateral movement of the base ring with respect to the burner cylinder when the base ring rests on the burner cylinder; and a top ring comprising:

a second ring adapted to receive the wok, wherein the second ring has a substantially circular shape;

a flange circumferentially projecting from the bottom of the second ring, wherein the outer diameter of the flange is less than the outer diameter of the second ring, wherein the top ring removably rests on the standoffs, and the flange of the top ring abuts the inner sides of the standoffs to inhibit lateral movement of the top ring with respect to the base ring and rests on each said ledge of each said standoff, the highest point of the first and second standoffs having a height greater than said second height and the first and second arcuate members being angled so that the top ring is inclined at said first angle when resting upon the arcuate standoff and the first and second standoffs.

* * * * *